United States Patent [19]

Neblett

[11] Patent Number: 4,936,020

[45] Date of Patent: Jun. 26, 1990

[54] LAYOUT TEMPLATE FOR PICTURE FRAMING MAT

[76] Inventor: Jimmie F. Neblett, 100 Cotton Acres Dr., Clinton, Miss. 39056

[21] Appl. No.: 336,704

[22] Filed: Apr. 12, 1989

[51] Int. Cl.[5] ..... B43L 13/20

[52] U.S. Cl. ..... 33/566; 33/1 G; 33/474; 33/476

[58] Field of Search ..... 33/1 R, 1 B, 1 G, 429, 33/474, 476, 562, 563, 566, 565, 501, 526, 527, 528

[56] References Cited

U.S. PATENT DOCUMENTS

| | | | |
|---|---|---|---|
| 313,197 | 3/1885 | Gaylord | 33/562 |
| 456,105 | 7/1891 | Adams | 33/428 |
| 513,665 | 1/1894 | Barberie | 33/474 |
| 720,824 | 2/1903 | Lieber | 33/566 |
| 1,295,041 | 2/1919 | Kekuewa | 33/476 |
| 1,742,684 | 1/1930 | Bowman | 33/563 |
| 1,751,366 | 3/1930 | Shaub | 33/476 |
| 2,334,913 | 11/1943 | Eisenberg | 33/566 |
| 2,418,421 | 4/1947 | Murray | 33/501 |
| 2,637,110 | 5/1953 | Gilbertson | 33/476 |
| 2,698,999 | 1/1955 | McCollum | 33/95 |
| 2,795,854 | 6/1957 | Perkal | 33/527 |
| 3,080,658 | 3/1963 | Pionone | 33/474 |
| 3,104,467 | 9/1963 | Young | 33/562 |
| 3,156,984 | 7/1964 | Palmer | 33/189 |
| 4,027,396 | 6/1977 | Pierce | 33/429 |
| 4,155,165 | 5/1979 | Gillingwater | 33/104 |
| 4,461,086 | 7/1984 | Sellers | 33/474 |

FOREIGN PATENT DOCUMENTS

| | | | |
|---|---|---|---|
| 429953 | 10/1911 | France | 33/429 |
| 282151 | 12/1947 | Switzerland | 33/429 |

*Primary Examiner*—Thomas B. Will

*Attorney, Agent, or Firm*—Nixon & Vanderhye

[57] ABSTRACT

A template is provided for marking a picture mat blank in preparation for subsequent cutting. The template is comprised of two planar arms, a mat-opening design cut into the re-entrant corner of the arms, and graduation lines on the arms for measuring the widths of the mat borders. The template is placed in position on the back of a mat blank so that the arms are parallel with the edges of the mat blank and the edges of the mat blank line up with the appropriate graduation lines for the border widths desired. The inside edge of the template is then traced onto the mat blank with a pencil. Layout marks which show users of mat cutting machines where to start and stop cutting may also be traced. In addition, mat-opening designs incorporating cut out circles and ovals in the mat blank may be laid out using the template.

7 Claims, 2 Drawing Sheets

LAYOUT TEMPLATE FOR PICTURE FRAMING MAT

This invention relates generally to templates and more particularly, to a template for use in laying out the corners of openings upon a mat board blank, so as to facilitate the removal of the middle in producing a picture mat.

Heretofore templates offered for this purpose were characterized by certain disadvantages making them undesirable for use. Among these disadvantages was an unnecessary bulkiness rendering the instruments unhandy in use. Earlier planar templates were difficult to align accurately on mat blanks because the arms of these templates were required to be placed perpendicular to the edges of the mat blank. Another disadvantage of earlier templates was that layouts made with them were partially concealed by the mat-cutting machines. Another disadvantage of earlier templates was that they were not well suited for laying out mat-opening designs incorporating round or oval holes made by oval cutting machines.

Accordingly, an important object of the invention is to provide an improved mat template which is simple in form and easy to use.

An important advantage of this invention is that it is easy to align accurately on the mat blank because the arms of the template and the graduation lines on the arms are parallel with the edges of the mat blank.

Still another object of the invention is to provide a template for making layout marks which are not concealed by the mat cutting machines used to cut the openings.

Another advantage of the present template is that it can be used for laying out mat-opening designs incorporating round or oval holes.

Other objects and advantages of the invention will become apparent during the course of the following description.

Figure 1:
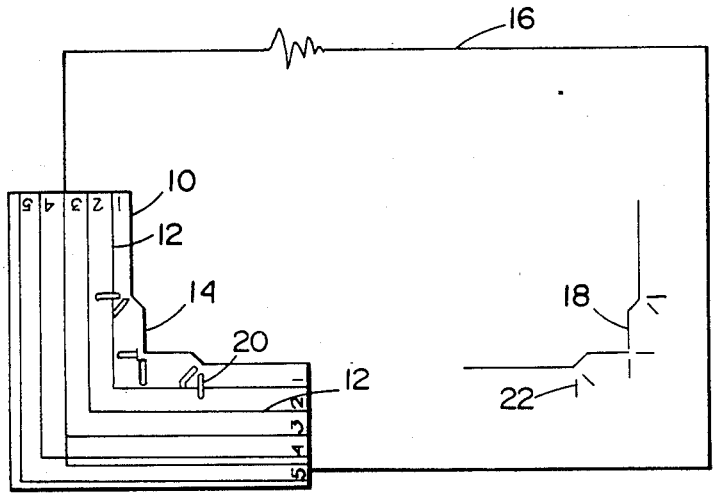
FIG. 1 is a top plan view of the device comprising the present invention in operative position on a fragment of a mat blank for the purpose of copying mat-opening designs thereon.

Referring to FIG. 1, numeral 10 designates the template which is comprised of a generally L-shaped thin transparent plate having measuring lines 12, a cut away design 14, and slots 20. Mat blank 16 is in position under the template. Design 18 and layout marks 22 have already been made on the lower right corner of the mat blank using template 10.

Figure 4:
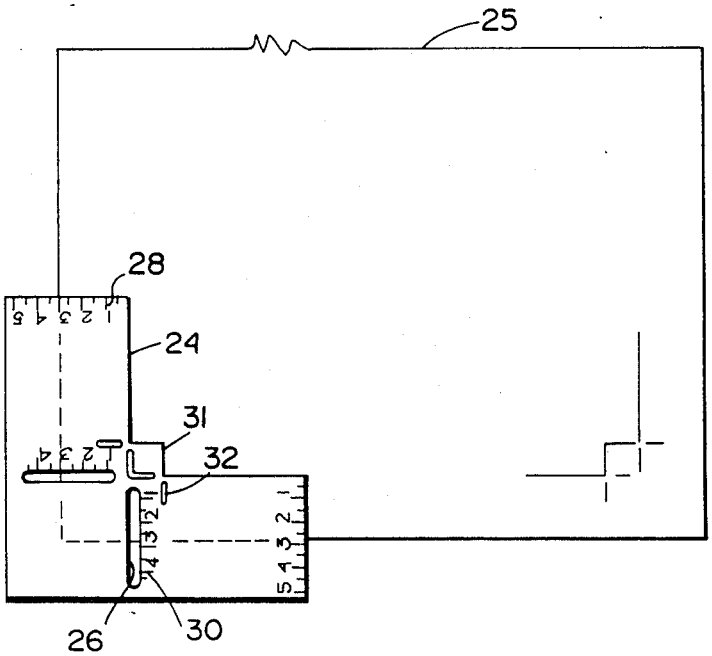
FIG. 4 is a top plan view of another device comprising the present invention in operative position on a fragment of a mat blank for the purpose of copying mat-opening designs thereon.
Figure 5:
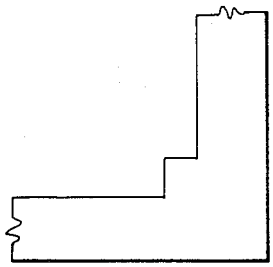
FIG. 5 is a fragmentary top plan view of a completed mat made with the template shown in FIG. 4.

FIG. 4 shows a mat blank 25 and an opaque template 24 having windows 26, measuring graduations 28 at the ends of the template, and measuring graduations 30 at the edges of said windows. A cut away design 31 and slots 32 are shown.

Figure 6:
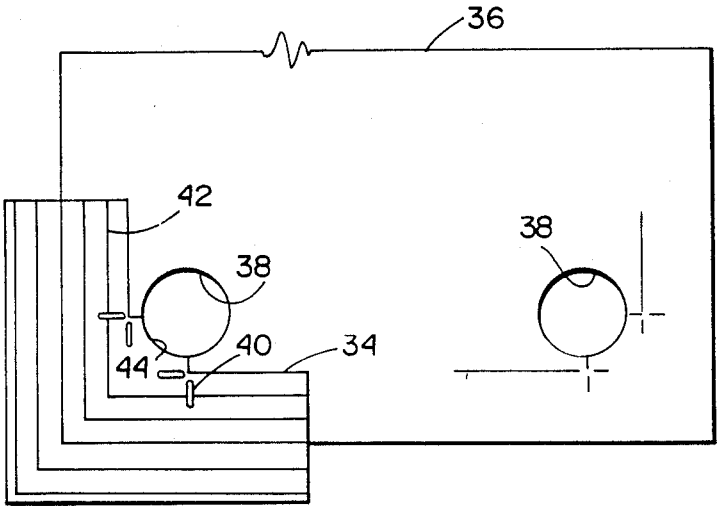
FIG. 6 is a top plan view of another template within the scope of this invention in operative position on a fragment of a mat blank for the purpose of copying mat-opening designs thereon.
Figure 7:
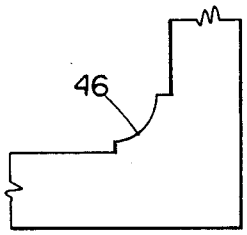
FIG. 7 is a fragmentary top plan view of a completed mat made with the template shown in FIG. 6.

FIG. 6 shows a transparent template 34, mat blank 36, round holes 38, slots 40, parallel lines 42, and cut away design 44.

By way of operation the template 10 in FIG. 1 is positioned by sliding it about on the back of a mat blank 16 until the edges of the mat blank line up with graduations 12 for the desired mat border widths and said graduation lines are parallel with the edges of the mat blank. While holding the template in place, the layout of the mat-opening design 14 may be drawn using the template as a guide.

Slots 20 may be used to make layout marks 22 on the mat blank 16. The slots are perpendicular to the straight-line elements in the mat-opening design and located approximately at the ends of said straight-line elements. The layout marks show operators of mat-cutting machines where to start and stop cutting.

When the layout marks 22 are on the back of the border, they are therefore easy to see when the mat blank is in the mat-cutting machine. Most mat-cutting machines conceal a strip of the mat blank adjacent to the mat border but do not conceal the border.

Figure 2:
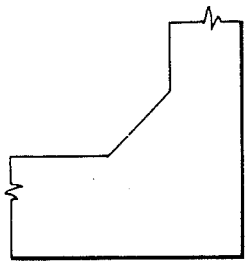
FIG. 2 is a fragmentary top plan view of a completed mat made with the template shown in FIG. 1.
Figure 3:
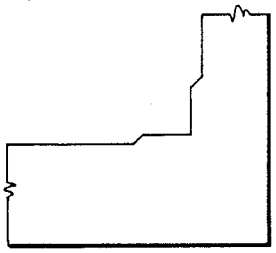
FIG. 3 is a fragmentary top plan view of another completed mat made with the template shown in FIG. 1.

Mats shown in FIGS. 2 and 3 were both made with template 10 shown in FIG. 1. The mat in FIG. 3 requires additional mat cutting steps.

Opaque template 24 in FIG. 4 is aligned by viewing a portion of the edges of the mat blank 25 through windows 26. The template is adjusted by sliding it about until the desired mat border width corresponds with the position of said edges on graduations 28 and 30.

Template 34 in FIG. 6 is positioned on mat blank 36 so that the circular part of the mat-opening design coincides with the edge of round hole 38 in the mat blank. The template is also positioned so that lines 42 on the template arms are parallel with the edges of the mat blank. Graduation labels on the lines 42 are unnecessary because mat border widths for this mat-opening design were established when holes 38 were cut in the mat blank 36.

By using the above described templates and variations within the scope of this invention, mat-opening-design layouts may be made quickly and accurately. Alignment of the template is easy because the arms of the template and graduations thereon are parallel with the edges of the mat blank. A relatively inexperienced person can properly layout a mat in only a few seconds. Templates within the scope of this invention are well suited to making layouts for use in modern mat-cutting machines because said layout marks are not concealed by said machines. Mat-opening designs incorporating round or oval holes are easy to lay out and easy to cut on mat cutting machines.

It is to be understood that while a few forms of this invention have been illustrated and described herein, it is not to be limited to the specific form or arrangement of parts herein described and shown except insofar as such limitations are included in the claims.

What I claim and desire to secure by Letters Patent is:

1. A template having a cut away design for use in laying out said design in an interior mat opening of a picture framing mat on a mat blank, said template comprising:

(a) two angularly-disposed transparent arms;

(b) said cut away design being of the re-entrant angle between two borders of said mat opening and being located at the inner re-entrant angle of said arms, wherein said cut away design is comprised of at least straight line elements, and (c) a plurality of graduation lines located on each said arm oriented parallel to an elongated side of said arm; and wherein said graduation lines have associated graduations commencing at the inside of each said arm and increasing toward the outside of each said arm.

2. A template having a cut away design for use in laying out said design in an interior mat opening of a picture framing mat on a mat blank, said template comprising:

(a) two angularly-disposed transparent arms;

(b) said cut away design being of the re-entrant angle between two borders of said mat opening and being located at the re-entrant angle of said arms wherein said cut away design is comprised of at least straight line elements;

(c) graduations commencing at the inside of each said arm and increasing toward the outside of each said arm, and (d) slots in said arms perpendicular to each of the straight-line elements of said mat-opening design and located approximately at the ends of each of said straight-line elements.

3. A template having a cut away design for use in laying out said design in an interior mat opening of a picture framing mat on a mat blank, said template comprising:

(a) two angularly-disposed arms;

(b) said cut away design being of the re-entrant angle between two borders of said mat opening and being located at the inner re-entrant angle of said arms, wherein said cut away design is comprised of at least straight line elements;

(c) at least one window in each said arm;

(d) a first set of graduation lines located along the ends of each said arm; and (e) a second set of graduation lines located along the edges of said window in each said arm, wherein said first and second sets of graduation lines are aligned with each other and parallel to an elongated side of said arm containing them.

4. A template having a cut away design for use in laying out said design in an interior mat opening of a picture framing mat on a mat blank, said template comprising:

(a) two angularly-disposed arms;

(b) said cut away design being of the re-entrant angle between two borders of said mat opening and being located at the re-entrant angle of said arms, wherein said cut away design is comprised of at least straight line elements;

(c) at least one window in each said arm, (d) a first set of graduation lines located along the edges of said arm;

(e) a second set of graduation lines located along the ends of said window in each said arm, and (f) slots in said arms perpendicular to each of the straight-line elements of said mat-opening design and located approximately at the ends of each of said straight-line elements;

wherein said firs and second sets of graduation lines are aligned with each other.

5. A template having a cut away design for use in laying out said design in an interior mat opening of a picture framing mat on a mat blank, said template comprising:

(a) two angularly-disposed elongated transparent arms;

(b) said cut away design being of the re-entrant angle between two borders of said mat opening located at the re-entrant angle of said arms;

(c) a plurality of lines located on each said elongated arm oriented parallel to said arms and wherein said design incorporates a portion of a circumference of a round or oval previously cut in the mat blank.

6. A method for laying out a design for an interior opening of a picture framing mat on a mat blank, practiced with a template having two elongated arms with each arm having graduation lines parallel to the direction of elongation of the arm, and a particular cut-out design at an inner corner, comprising the steps of:

using the template having the particular cut-out design desired;

aligning the arms of the template with corresponding sides of the mat blank by selecting one of the graduation lines on each said arm for aligning with one of the corresponding sides of the mat blank; tracing said design on the mat blank; and cutting out the particular cut-out design.

7. The method of claim 6, wherein the template has a window in each said arm with the graduation lines being adjacent to each window adjacent to an end of each said arm, and wherein said aligning step comprises the additional steps of:

selecting a first one of said graduation lines adjacent to said window on each said arm;

selecting a second one of said graduation line at the end of each said arm which is aligned with said first selected line for aligning with one of the corresponding sides of the mat blank.

* * * * *